US005243840A

United States Patent [19]

Grafen et al.

[11] Patent Number: 5,243,840

[45] Date of Patent: Sep. 14, 1993

[54] APPARATUS FOR WET TREATMENT OF TEXTILE MATERIAL

[75] Inventors: Karl Grafen, Wurselen; Hans Kreitz, Stolberg, both of Fed. Rep. of Germany

[73] Assignee: H. Krantz GmbH & Co., Aachen, Fed. Rep. of Germany

[21] Appl. No.: 873,816

[22] Filed: Apr. 27, 1992

[30] Foreign Application Priority Data

Jun. 11, 1991 [DE] Fed. Rep. of Germany ..... 4119152

[51] Int. Cl.[5] ..... D06B 5/08

[52] U.S. Cl. ..... 68/62; 68/177; 68/178

[58] Field of Search ..... 68/177, 178, 181 R, 68/62, 175, 20

[56] References Cited

U.S. PATENT DOCUMENTS 3,685,325 8/1972 Carpenter ..... 68/177
3,718,012 2/1973 Vinas ..... 68/177
4,020,658 5/1977 Thies, Jr. ..... 68/177
4,129,017 12/1978 Green ..... 68/177
4,570,404 2/1987 Thompson ..... 68/178
4,766,743 8/1988 Biancalani et al. ..... 68/177

*Primary Examiner*—Frankie L. Stinson
*Attorney, Agent, or Firm*—Mark T. Basseches

[57] ABSTRACT

A textile treatment apparatus for an endless textile hank is comprised of a vessel having a dwell or treatment zone at a lower portion thereof and an upper acceleration or feed zone above said dwell zone. A blower assembly mounted in the roof the vessel above the acceleration zone advances the hank by subjecting said to a purely gaseous stream so as to remove the hank from the exit of the dwell zone and introduce it into the entrance of such zone. Treatment nozzles located at the entry to the dwell zone saturate the hank and aid in guiding it unimpeded into the dwell zone. The location of the blower assembly or assemblies at the upper extremity of the vessel facilitate servicing and minimize fluid introduction into the gaseous feed stream.

10 Claims, 2 Drawing Sheets

APPARATUS FOR WET TREATMENT OF TEXTILE MATERIAL

BACKGROUND AND FIELD OF THE INVENTION

This invention relates to an apparatus for the wet treatment of textile material in the form of an endless hank. The apparatus consists of a closable vessel which is divided into a dwell zone for receiving the hank in loops and an acceleration zone disposed thereabove and causing the hank to circulate. The dwell zone is formed by an arcuate duct with inlet and outlet openings pointing respectively in the outlet and input directions of the acceleration zone. The acceleration zone contains a deflecting roll freely rotatable above the outlet opening of the duct and an annular nozzle receiving a gas stream from a radial blower. The outlet opening of the annular nozzle points in the direction of the inlet opening of the duct. Nozzles applying treatment bath to the hank are disposed downstream of the annular nozzle in the direction of hank circulation.

PRIOR ART

An apparatus of this general type is known from French Patent Application 87 12171 (2,618,834) and uses a gaseous propulsion medium for the hank instead of the normally used liquid treatment medium to accelerate the hank more gently and to keep it in continuous circulation. The gas stream produced by a radial blower installed in the center of the vessel and fed direction from the interior of the vessel not only constitutes a gentler propulsion means, in contrast to the treatment bath, but simplifies the construction of the apparatus and lowers the operating costs thereof as compared with different models operated with treatment bath as propulsion medium.

The known apparatus has two major disadvantages:

For one thing, as a result of the central arrangement of the radial blower inside the vessel, inevitably treatment bath is entrained by the gas stream drawn therefrom and consequently a gas/liquid mixture hits the hank less gently than would a purely gaseous propulsion medium. Moreover, the known apparatus requires a higher driving power due to the greater weight of the mixed gas-liquid propulsion medium.

Secondly, since the blower axis of the device is disposed essentially coaxial with the horizontal vessel axis the simultaneous independent treatment of several successive textile hanks inside the vessel, which would be a substantial economic improvement with respect to the cost of construction and operation of such machines, cannot be attained. Due to the arrangement of the blower of the known device it is not possible to adapt the device to process a plurality of hanks at different speeds in the same vessel.

SUMMARY OF THE INVENTION

It is an object of the invention to design a treatment apparatus of the initially described kind so that a radial blower can easily be arranged in the interior of the vessel, the suction-side intake areas of which is effectively shielded from the bath, and that furthermore several hank circulation paths can be formed in the interior of the vessel, each of which can have independently operable radial blowers assigned to it.

For the solution of the problems presented by the aforesaid device, the present invention provides a treatment apparatus including a vessel having a lower dwell zone in the form of an arcuate duct the input and outlet ends of which open to the outlet and input ends respectively of an acceleration zone disposed above the duct. A blower discharges gas into a nozzle in the acceleration zone to advance the hank.

A characterizing feature of the present invention is that in the jacket of the vessel there is installed in a simple manner a radial blower directly contiguous thereto and in the interior of the vessel. The vertical orientation of the axis of the radial blower, having a housing connected to the inner side of the vessel, makes it possible to place along the axial extent of the vessel several radial blowers arranged in this manner flat against the vessel roof whereby they are removed from the catchment area of the bath. The blowers may be driven independently of each other permitting different treatments along the vessel. The opposed arrangement of the roof-side opening in the housing of the radial blower and of the roof opening of the vessel allows free access to the interior of the blower housing, so that the impeller is easy to take out and reinstall for purposes of maintenance and inspection. For this purpose it suffices to remove the flange that covers the opening, which flange is close to the exterior of the vessel and it too is therefore freely accessible. Due to the arrangement of the drive motor on the flange, it is possible, as soon as the flange is removed, to take the impeller of the radial blower off the vessel and to reinstall it together with the drive motor as a structural unit. The pressureproof lead-through of the motor shaft through the bushing enclosed by the flange completes the preassembly unit. The suction hole provided in the housing of the radial blower at the bottom lies in an area into which bath particles entrained by the hank cannot readily get, even at high speeds of circulation thereof. The ejection opening tangential to the housing of the radial blower can be connected directly with the annular nozzle over a relatively short piece of pipe.

According to one embodiment of the invention, a guiding tube pivotable about a vertical axis and opening into the inlet opening of the duct is arranged on the outlet side of the annular nozzle.

The guiding tube, pivotable to and from horizontally by a crank drive for example, leads the textile hank toward the inlet opening of the arcuate duct, so that the textile hank is deposited therein with uniform loop formation and in this orderly manner can travel through the dwell zone.

According to another embodiment of the invention, the duct inlet opening of rectangular cross section is equipped with at least two opposed, horizontally extending apertured soffits, each with at least one row of nozzles adapted to discharge treatment bath.

By the preferably slit-like nozzles arranged over the width of the inlet opening of the duct in the lead-in zone of the guiding tube above and below the hank path, the textile hank is centrally supported between the nozzles and wetted uniformly with a curtain of treatment bath continuously before it dips wholly or partly into the treatment bath in the lower area of the duct.

Lastly an embodiment of the invention further provides that the spray nozzles can be fed via pressure lines of a pump which is connected to a suction line drawing fluid from a sump at the bottom region of the vessel.

The apparatus according to the invention can be run at an extremely small and hence especially economical bath ratio if all secondary groups, such as heating units, bath pump and filter, are arranged below the bath level that establishes itself in the duct of the dwell zone. Owing to this, a sufficient bath quantity is always available to the suction side of the pump event at a bath ratio of only 1:2 for example. By arranging the secondary groups below the bath level it is ensured furthermore that this level drops but little when the pump is turned on.

DETAILED DESCRIPTION OF DRAWING

Figure 1:
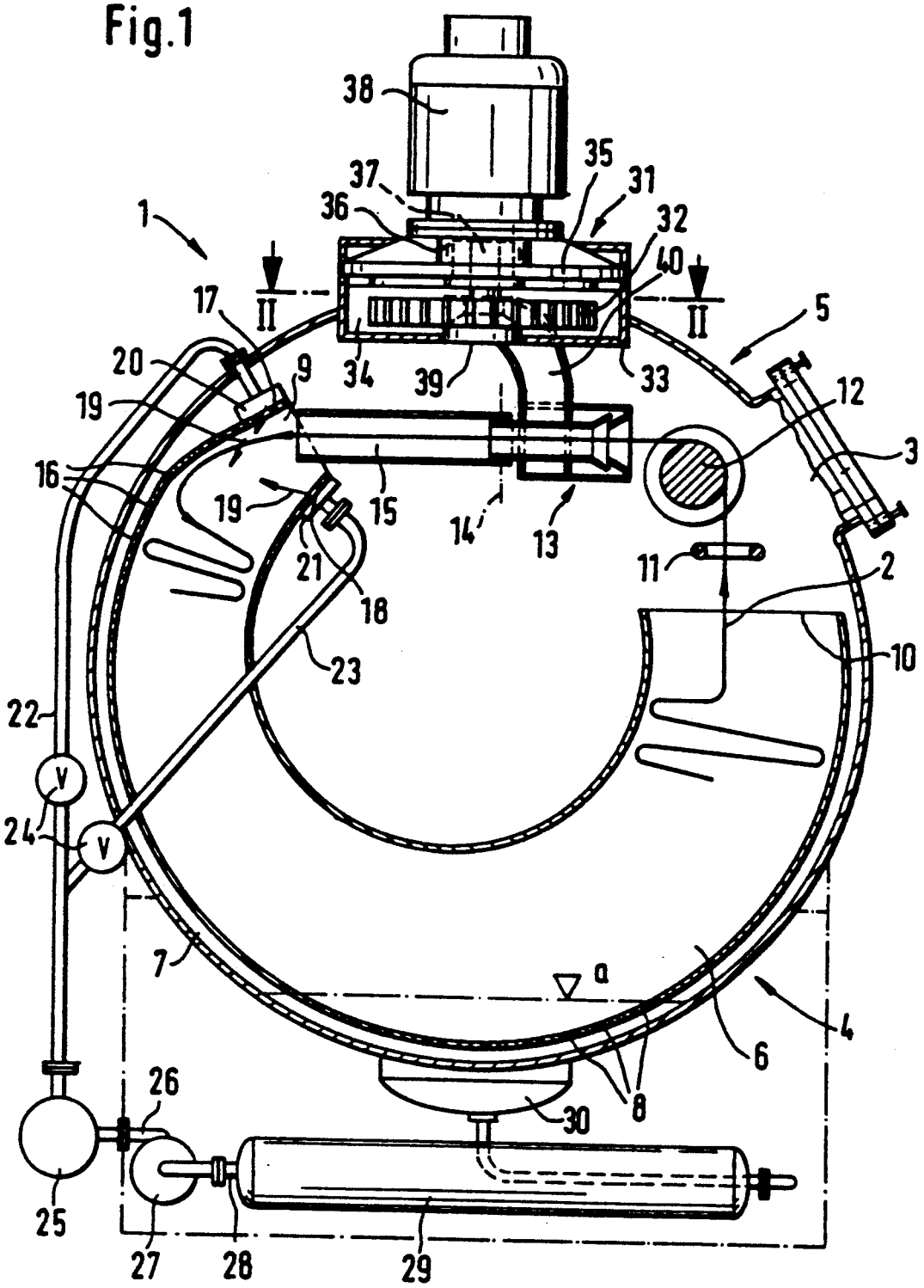
FIG. 1 shows a vertical section through the apparatus.
Figure 2:
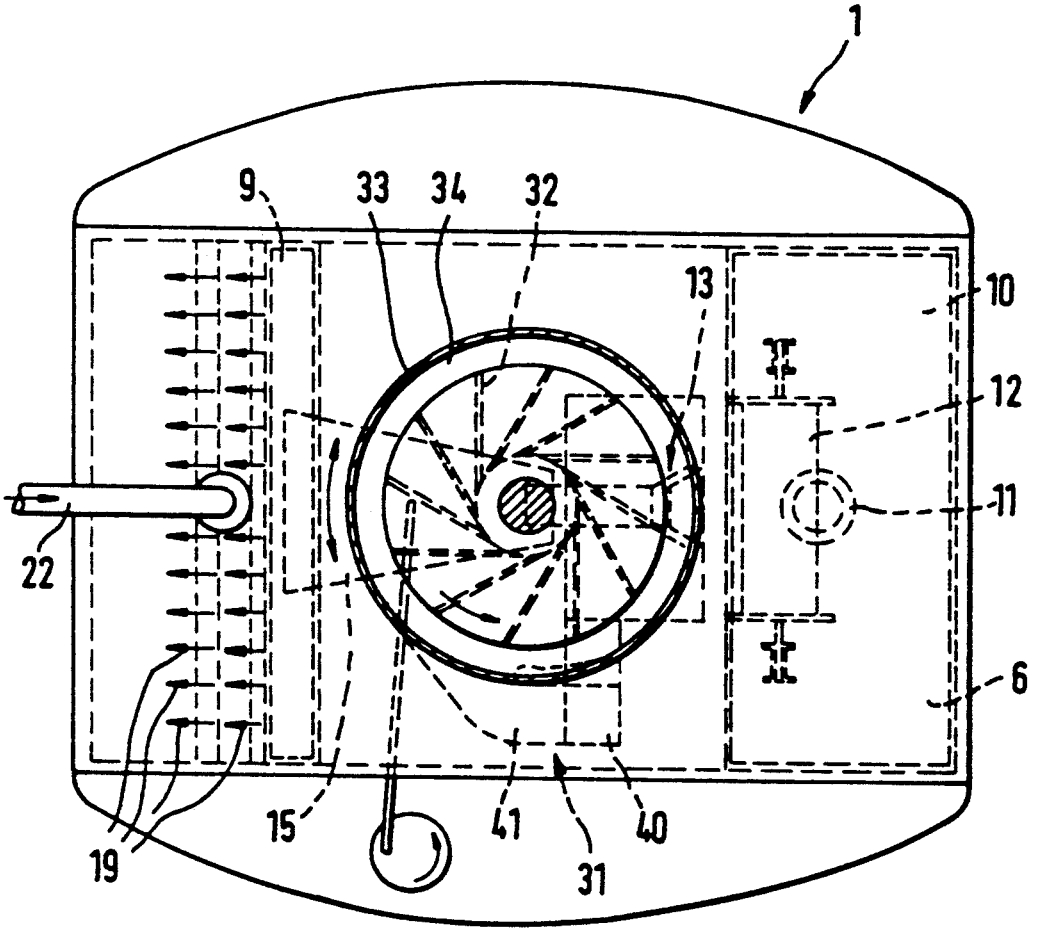
FIG. 2 a horizontal section along line II—II of FIG. 1.

The apparatus comprises a substantially cylindrical vessel 1, with its longitudinal axis disposed horizontally, in which at least one endless textile hank 2 circulates in a substantially vertical direction, being treated with dye bath for example. To this end, an end of each textile hank 2 is introduced into vessel 1 in conventional manner as piece goods of a certain length through a closable opening 3, until the end passes through the apparatus whereupon the fed-through end is connected to the other end of the hank.

In vessel 1 are provided a low dwell zone 4, receiving the textile hank 2 in loops, and an upper acceleration zone 5 causing the textile hank 2 to circulate.

The dwell zone 4 is formed by a duct 6 of rectangular cross section, which radially outward defines a gap 7 with the inner side of vessel 1. Through perforations 8 in the bottom wall of duct 6 the interior of the duct communicates directly with gap 7 and also with the rest of the interior of the vessel.

An inlet opening 9 and an outlet opening 10 of duct 6 define the dwell zone 4 and point in the direction of the extremities of acceleration zone 5.

The acceleration zone 5 comprises—seen in circulating direction of the textile hank 2—a guide ring 11 arranged spaced parallel over the horizontal cross section of the outlet opening 10, the normally vertical central axis of which forms a tangent to the outer circumference of a deflection roll 12 freely rotatably mounted. The textile hank 2 is conveyed via the deflection roll 12 to the center of an annular air admission nozzle 13, whereby a drive force in circulating direction is exerted on the textile hank 2, so that it is forced into the inlet opening 9 in proportion as it is extracted from the outlet opening 10. In so doing, the textile hank 2 passes through a guiding tube 15 in the form of a flattened funnel contiguous to the outlet side of the annular nozzle 13 and pivotable by a crank drive in horizontal plane about a vertical axis 14, the clear cross-section of said funnel increasing continuously in transport direction of the textile hank 2.

Opposite the end of the guiding tube 15 protruding into duct 6 toward the inlet opening 9 lies a wall surface of duct 6 provided with perforations 16, which wall surface is inclined so that the textile hank 2 impinging thereon is deflected downwardly.

At two opposite aperture soffits 17, 18 extending horizontally, the inlet opening 9 of rectangular cross section is provided with nozzles 19 distributed over the length thereof which nozzles are fed with treatment bath from contiguous chambers 20,21. The bath jets issuing from the chamber 21 disposed below the hank path form a supporting curtain of jets which contributes to the deposition of the textile hank 2 issuing in a spread state from the funnel-shaped guiding tube 15 in orderly loops in duct 6.

Feeding of bath to the chambers 20, 21 occurs via lines 22, 23 which are provided with control valves 24 and are connected, with interpositions of a filter 25, to the pressure line 26 of a pump 27. A suction line 28 of pump 27 communicates with a vessel sink 30 via a heat exchanger 29 by which the bath is heated up and maintained at a desired temperature. The filter 25, pump 27, and heat exchanger 29 are arranged below the bath level in vessel 1 marked "A".

In the zenith of vessels 1, a radial blower 31 is installed, the impeller 32 of which rotates about a vertical axis and whose housing 33 open at the roof is contiguous to a roof opening 34 in the jacket of vessel 1. The roof opening 34 is provided with a flange 35 screwed to the jacket of vessel 1 on the exterior thereof. Said flange encloses a bushing 36, through which is pressure sealingly passed a drive shaft 37 for the impeller 32. The drive shaft 37 forms part of a motor 38 mounted on flange 35.

In the housing 33, at the bottom, a suction port 39 is provided, via which the radial blower 31 is supplied with air from the interior of vessel 1. Guide tube 15, as shown, intervenes between port 39 and the bath to aid in blocking liquid from entering the port via a conduit segment 40, an exhaust opening 41 formed tangentially of the side of the housing 33 is connected with the annular nozzle 13 and acts upon the latter with the air stream delivered by the radial blower of the drive of the textile hank 2.

Depending on the axial extent of vessel 1, the above described equipments can be arranged in multiple number distributed over the length of the vessel, so that using the apparatus a corresponding number of textile hanks 2 can be treated independently of each other simultaneously.

From the foregoing description, it will be appreciated that there is provided, in accordance with the invention, a textile treatment device which gently and efficiently advances an endless hank of textile through a treatment zone. The propulsion of the hank is effected by a purely gaseous stream thereby reducing power consumption. By locating the blower-propulsion system in the uppermost portion of the treatment vessel servicing of the systems is facilitated and induction of liquid components of the treatment bath into the blower is minimized.

As will be apparent to skilled workers in the art familiarized with the disclosure hereof, numerous variations in details of construction may be effected without departing from the spirit of the invention. Accordingly, the invention is to be broadly construed within the scope of the appended claims.

Having thus described the invention and illustrated its use, what is claimed as new and is desired to be secured by Letters Patent is:

1. In a treatment apparatus for the treatment of endless naks of textile material and comprising a vessel having dwell means at a lower portion thereof, said dwell means comprising an arcuate duct, an acceleration zone above said dwell means, said acceleration zone having an entry end and an exit end, inlet and outlet openings in said duct directed respectively toward said exit and entry ends of said acceleration zone, an annular nozzle means in said acceleration zone directed toward said inlet opening of said duct, and treatment spray means down-stream of said acceleration zone for applying treatment bath to said hank, the improvement which comprises an opening in said vessel above said acceleration zone, radial blower means removably mounted in said opening, said blower means including a housing disposed within said vessel, motor means mounted on said housing externally of said vessel in driving connection with said blower, suction and exhaust ports formed in said housing, and conduit means linking said exhaust port to said nozzle means for inducing gaseous flow through said acceleration zone and toward said inlet opening of said duct to thereby advance increments of said hank through said acceleration zone and into said inlet opening.

2. Apparatus in accordance with claim 1 wherein said housing includes vertically arranged sidewalls and a horizontally directed bottom wall and wherein said suction port is formed in said bottom wall, and said exhaust port is formed in said sidewall and arranged generally tangentially of said housing.

3. Apparatus in accordance with claim 1 and including a guide tube interposed between said nozzle means and said inlet opening of said duct, said guide tube being generally horizontally disposed, said guide tube including means mounting the same for pivotal movement about a vertical axis.

4. Apparatus in accordance with claim 3 wherein said guide tube includes a narrow end adjacent said nozzle means and a wide end adjacent said inlet opening.

5. Apparatus in accordance with claim 1 wherein said duct includes a bottom wall portion in proximate spaced relation to the bottom of said vessel, said bottom wall portion of said duct being perforate.

6. Apparatus in accordance with claim 1 wherein said duct, at said inlet end, is generally rectangular in transverse section, and said spray means is disposed in said duct adjacent said inlet end and includes first and second discharge nozzles, said discharge nozzles being directed toward the axis of said duct and toward each other to thereby centralize said hank between streams of treatment bath emitted by said discharge nozzles.

7. Apparatus in accordance with claim 6 and including sump means in the bottom of said vessel for collecting treatment bath, pump means having an inlet conduit connected to said sump means and an outward conduit connected to said discharge nozzles.

8. In a treatment apparatus for the treatment of endless hanks of textile material and comprising a vessel having dwell means at a lower portion thereof, said dwell means comprising an arcuate duct, an acceleration zone above said dwell means, said acceleration zone having an entry end and an exit end, inlet and outlet openings in said duct directed respectively toward said exit and entry ends of said acceleration zone, an annular nozzle means in said acceleration zone directed toward said inlet opening of said duct, and treatment spray means downstream of said acceleration zone for applying treatment to said hank, the improvement which comprises an opening in said vessel above said acceleration zone, radial blower means, removably mounted in said opening, said blower means, including a housing disposed within said vessel, suction and exhaust ports formed in said housing, and conduit means linking said exhaust port to said nozzle means for inducing gaseous flow through said acceleration zone and toward said inlet opening of said duct to thereby advance increments of said hank through said acceleration zone and into said inlet opening, said housing including vertically arranged sidewalls and a horizontally directed bottom wall, said suction port being formed in said bottom wall, and said exhaust port being formed in sidewall and arranged generally tangentially of said housing.

9. In a treatment apparatus for the treatment of endless hanks of textile material and comprising a vessel having dwell means at a lower portion thereof, said dwell means comprising an arcuate duct, an acceleration zone above said dwell means, said acceleration zone having an entry end and an exit end, inlet and outlet openings in said duct directed respectively toward said exit and entry ends of said acceleration zone an annular nozzle means in said acceleration zone directed toward said inlet opening of said duct, and treatment spray means downstream of said acceleration zone for applying treatment bath of said hank, the improvement which comprises an opening in said vessel above said acceleration zone, radial blower means removably mounted in said opening, said blower means including a housing disposed within said vessel, suction and exhaust ports formed in said housing, and conduit means linking said exhaust port to said nozzle means for inducing gaseous flow through said acceleration zone and toward said inlet opening of said duct to thereby advance increments of said hank through said acceleration zone and into said inlet opening, said apparatus including a guide tube interposed between said nozzle means and said inlet opening of said duct, said guide tube being generally horizontally disposed and including means mounting the same for pivotal movement about a vertical axis.

10. Apparatus in accordance with claim 9 wherein said guide tube includes a narrow end adjacent said nozzle means and a wide end adjacent said inlet opening.

* * * * *